US005784817A

United States Patent [19]

Behme

[11] Patent Number: 5,784,817

[45] Date of Patent: Jul. 28, 1998

[54] PICTURE HOLDER AND ORNAMENTAL FRAME

[76] Inventor: Jerome G. Behme, 2910 Zanzibar La., Plymouth, Minn. 55447

[21] Appl. No.: 614,401

[22] Filed: Mar. 12, 1996

[51] Int. Cl.[6] ..... G09F 1/12

[52] U.S. Cl. ..... 40/748; 40/711; 40/753; 40/756; 40/798

[58] Field of Search ..... 40/711, 748, 753, 40/760, 798, 749, 756; 248/455, 456

[56] References Cited

U.S. PATENT DOCUMENTS

| | | | |
|---|---|---|---|
| 2,550,926 | 5/1951 | Herz | 40/749 |
| 2,984,922 | 5/1961 | Ladenburger et al. | 40/760 |
| 3,707,791 | 1/1973 | Levy | 40/748 X |
| 3,766,676 | 10/1973 | Slemmons | 40/760 X |
| 4,113,212 | 9/1978 | Cariden | 248/455 |
| 4,261,124 | 4/1981 | Carter | 40/760 X |
| 4,622,767 | 11/1986 | Sullivan | 40/753 X |
| 4,785,562 | 11/1988 | Good | 40/711 |
| 5,050,834 | 9/1991 | Tardiff | 40/711 X |
| 5,072,532 | 12/1991 | Kelly | 40/798 X |
| 5,075,991 | 12/1991 | Wenkman et al. | 40/711 X |
| 5,082,230 | 1/1992 | Chang | 248/455 X |

*Primary Examiner*—Kenneth J. Dorner
*Assistant Examiner*—Andrea Chop
*Attorney, Agent, or Firm*—Palmatier, Sjoquist Voigt & Christensen, P.A.

[57] ABSTRACT

A picture holder and frame having a graphical image applied to a flat front surface and having a photo recess in the front surface sized to accept a photograph. The graphical image on the front surface provides an ornamental design, and the perimeter edge of the picture holder is conformed to follow the outline of the ornamental design. The rear surface of the picture holder includes a pivotal leg for serving as a stand support member and a magnetic strip for applying and adhering the picture holder to a metallic surface.

4 Claims, 4 Drawing Sheets

PICTURE HOLDER AND ORNAMENTAL FRAME

BACKGROUND OF THE INVENTION

The present invention relates to a device for holding photographs which is shaped into an ornamental frame assembly suitable for hanging, adhering to a metal surface, or standing on a horizontal surface. The device is particularly adaptive to hold small photographs of the type which are typically made for students at various grade levels. Such photographs typically measure about 1½ by 2 inches and are produced in quantity for students to give away to their relatives and friends. The present invention provides a novel holder for such photographs which may be constructed into a number of forms which may be uniquely related to the student's age level or to seasonal occasions. The ornamentation applied to the photograph holder provides a unique topical reference to the student or to a seasonal or school-related event.

SUMMARY OF THE INVENTION

The invention comprises a picture holder having a plan view shape corresponding to a unique ornamentation wherein the perimeter of the holder has a uniform, raised edge which follows the ornamentation shape. The raised edge extends rearwardly from a flat front surface to provide a uniform lip about the entire periphery. A recessed opening through the front surface is sized to accept a small photograph and includes a inset surface having a surface backing for adhesively fixing the photograph within the recess. The rear surface of the holder comprises a flat surface magnet affixed to a cover which itself may be affixed to the rear surface. The cover includes an elongate groove. A pivotal leg has an elongate member captured within the elongate groove of the cover, the leg being pivotal about the elongate member from a first position adjacent the rear surface to a second position projecting outwardly from the rear surface, whereby a foot on the projecting leg portion provides a stabilizing foot for resting on a horizontal surface.

It is a principal object of the present invention to provide a decorative or ornamental picture holder assembly which may be mounted to a hanger or magnetically affixed to a metal surface or placed in a standing position on a horizontal surface.

It is another object and advantage of the present invention to provide an ornamental shape for receiving a photograph within a surface recess wherein the ornamental shape also includes a graphical image applied to the front surface.

The foregoing and other objects and advantages will become apparent from the following specification and claims and with reference to the appended drawings.

DESCRIPTION OF THE PREFERRED EMBODIMENT

Figure 1:
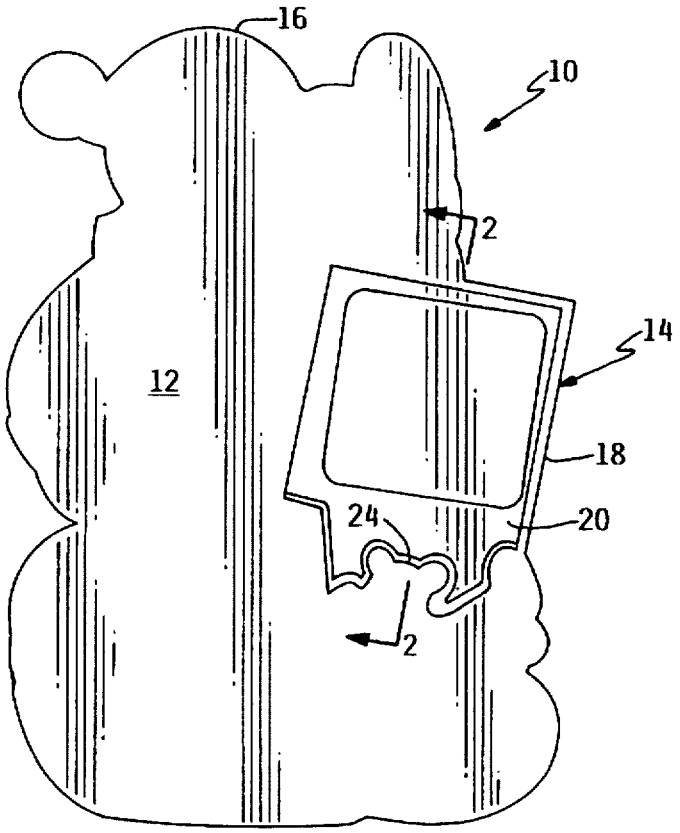
FIG. 1 shows a front plan view of one example of an ornamental shape incorporating the picture holder.

FIG. 1 shows a front plan view of a picture holder 10, illustrating one example of an ornamental shape. Picture holder 10 includes an image portion 12 and a photograph recess portion 14. The perimeter 16 of picture holder 10 is shaped to conform to and accentuate the image portion 12, and the entire front surface of the image portion 12 may include a pictorial or graphical representation of the image. The pictorial or graphic image is preferably applied as a decal to the flat surface comprising the image portion 12. For example, picture frame 10 is shaped into the ornamental design of a Santa Claus image, wherein the photo recess 14 appears to be protruding from Santa's bag of gifts. The photo recess 14 includes a raised edge 18 surrounding a recessed surface 20; the recess surface 20 is sized to accept the insertion of a photograph of about 1½×2 inches.

Figure 2:
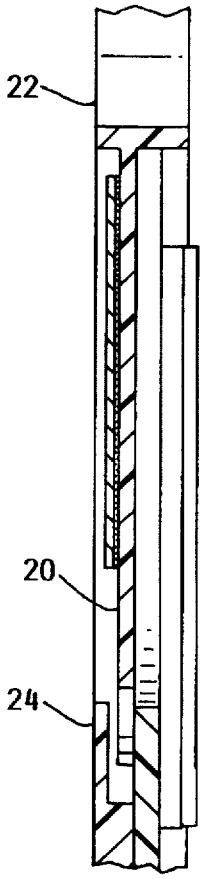
FIG. 2 shows a view taken along the lines 2—2 of FIG. 1.

FIG. 2 shows a cross-section view taken along the lines 2—2 of FIG. 1, illustrating the relationship of the recess surface 20 to the top surface 22 which contains the image portion 12. The recess surface 20 is preferably rectangular in shape, although the lower portion, as illustrated in FIG. 2, may be at least partially covered by an over projection 24 of the top surface 22. The picture holder 10 may have a thickness 26 of approximately ¼ inch, to accommodate the various components of the picture holder 10 which will be hereinafter described.

Figure 3:
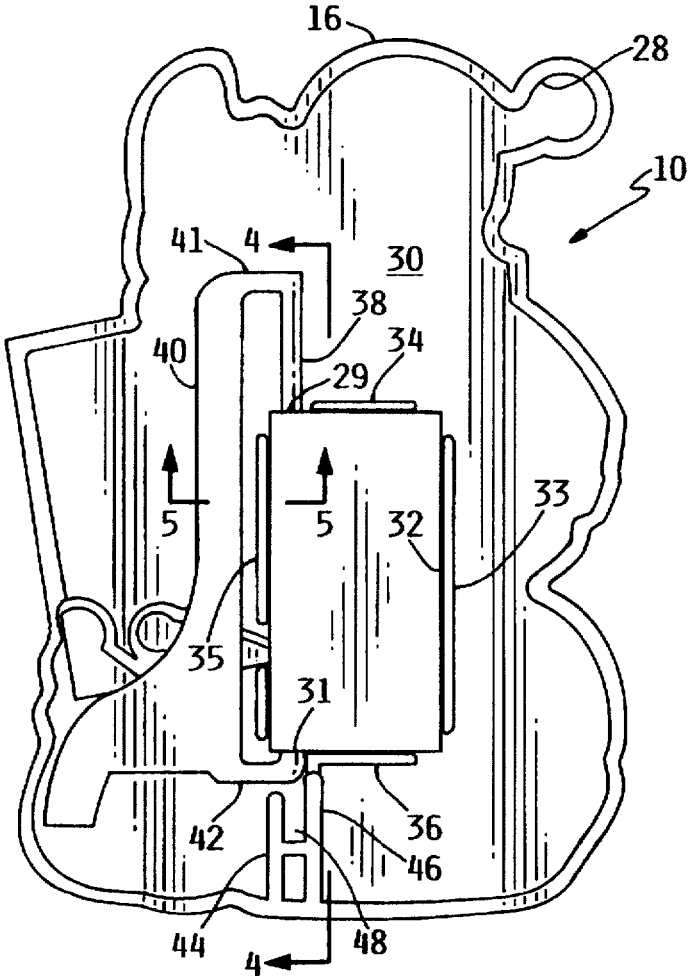
FIG. 3 shows a rear plan view of the device of FIG. 1.

FIG. 3 shows a rear plan view of picture holder 10 in the same ornamental form as shown in FIG. 1. The outer perimeter 16 is formed by a raised edge 28 which surrounds an inner recess 30. The outer perimeter 16 follows the general outline of the pictorial or graphic image applied to the image portion 12. A number of raised ribs are formed on the inner recess 30, to provide various projecting members for purposes to be hereinafter described. A rectangular housing 32 is confined within an area defined by raised ribs 33, 34, 35, 36. Housing 32 has a pair of slotted end walls 29, 31 to permit the pivotal containment of a cylindrical hinge 38. Hinge 38 is joined to a stand member having a leg 40 by spacing projections 41, 42. As constructed, hinge 38 is rotatably pivotal within the slots 29, 31 through housing 32, thereby to permit leg 40 to be pivotally moved from a flat position to a rearwardly-projecting position. The flat position is shown in FIG. 3, wherein leg 40 is adjacent the inner recess 30. An upstanding rib 44 limits the axial movement of hinge 38.

The leg 40 may be pivotally rotated about hinge 38 to a position which is proximately normal to the inner recess surface 30. In this position, leg 40 and hinge 38 may be slidably moved downwardly to engage the lower portion of hinge 38 into a channel 48 which is formed between ribs 44 and 46. When so engaged, the further pivotal movement of leg 40 is restricted and leg 40 remains in an outwardly projecting position for supporting the picture holder 10 on a flat surface. The picture frame 10 may be returned to its flat form by, merely slidably moving hinge 38 and leg 40 upwardly until hinge 38 is no longer engaged into channel 48. In this raised position, leg 40 may once again be pivotally moved about hinge 30 into a flat alignment against the inner recess surface 30.

Figure 4:
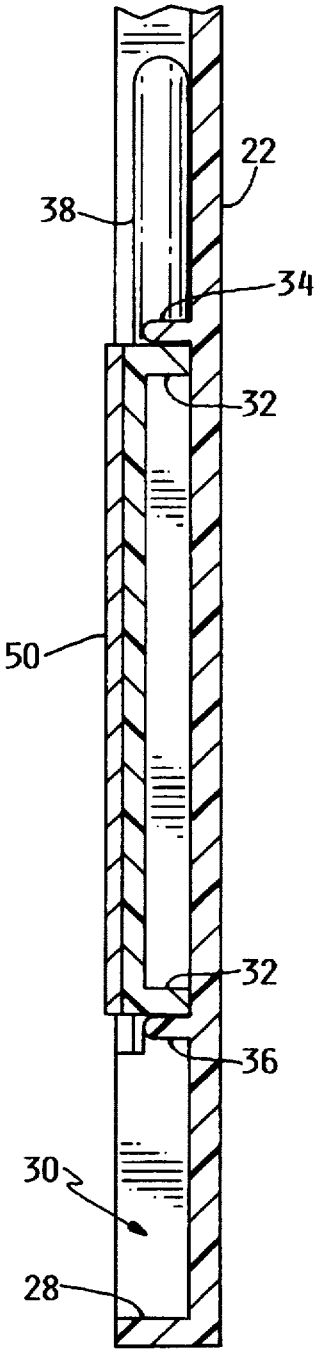
FIG. 4 shows a cross-section view taken along the lines 4—4 if FIG. 3.
Figure 5:
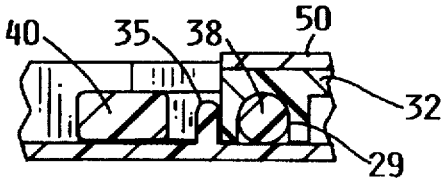
FIG. 5 shows a cross-section view taken along the lines 5—5 of FIG. 3.

FIG. 4 shows a cross-section view taken along the lines 4—4 of FIG. 3. This view illustrates the relative positions of hinge 38, housing 32, and ribs 34, 36, all located within the inner recess 30. FIG. 5 shows a cross-section view taken along the lines 5—5 of FIG. 3.

This view illustrates hinge 38 confined within housing 32 and pivotal along its axial length by passage through slots 29, 31. FIGS. 4 and 5 also illustrate an optional magnetic strip 50 which may be affixed to the outer surface of housing 32. Magnetic strip 50 is particularly useful for attaching the picture holder 10 to a metallic surface when the leg 40 is pivotally positioned against the inner recess surface 30.

FIGS. 6–9 show a second and alternative embodiment of the invention. In this embodiment, a picture holder 100 is formed into the shape of an apple and has an image portion 120 and a photo recess 140. The image portion 120 can be ornamentally decorated and colored to show an apple appearance, and it should be appreciated that a wide variety of other images and shapes could be chosen to form a different variant of picture holder. However, in all choices, the various embodiments incorporate the features of the invention described herein.

The perimeter 160 of picture holder 100 is shaped to conform to and accentuate the image portion 120, and the entire front surface of the image portion 120 may include a pictorial or graphical representation of the image. The photo recess 140 is sized to accept the insertion of a photograph of approximately 1½×2 inches, which may be snugly fitted against recess surface 200.

Figure 6:
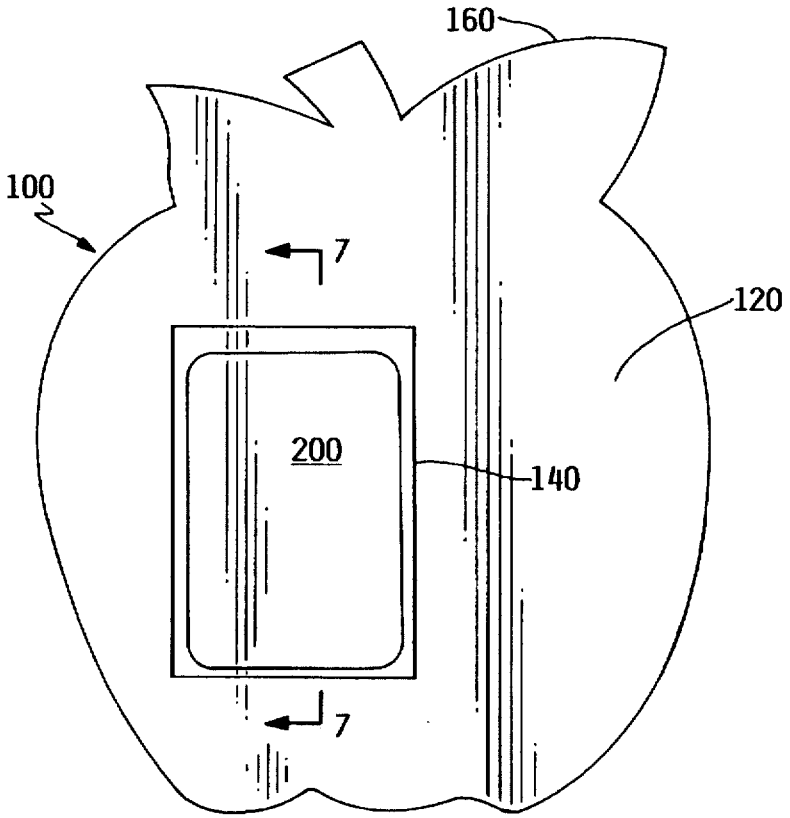
FIG. 6 shows a further ornamental shape incorporating the photograph holder.
Figure 7:
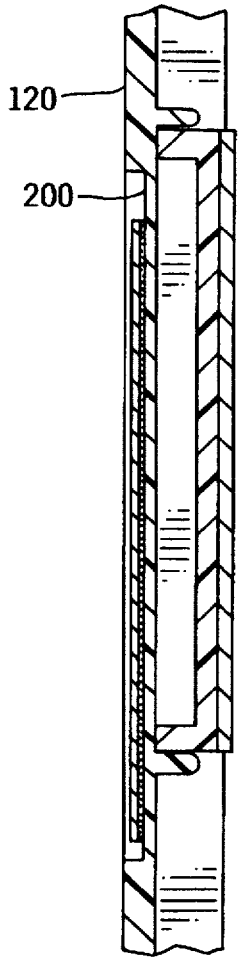
FIG. 7 shows a cross-section view taken along the lines 7—7 of FIG. 5.

FIG. 7 shows a cross-sectional view taken along the lines 7—7 of FIG. 6, illustrating the relationship between recess surface 200 and image surface 120. The picture holder 100 may have a thickness 260 of approximately ¼ inch to accommodate the various components of the picture holder 100 which will be hereinafter described.

Figure 8:
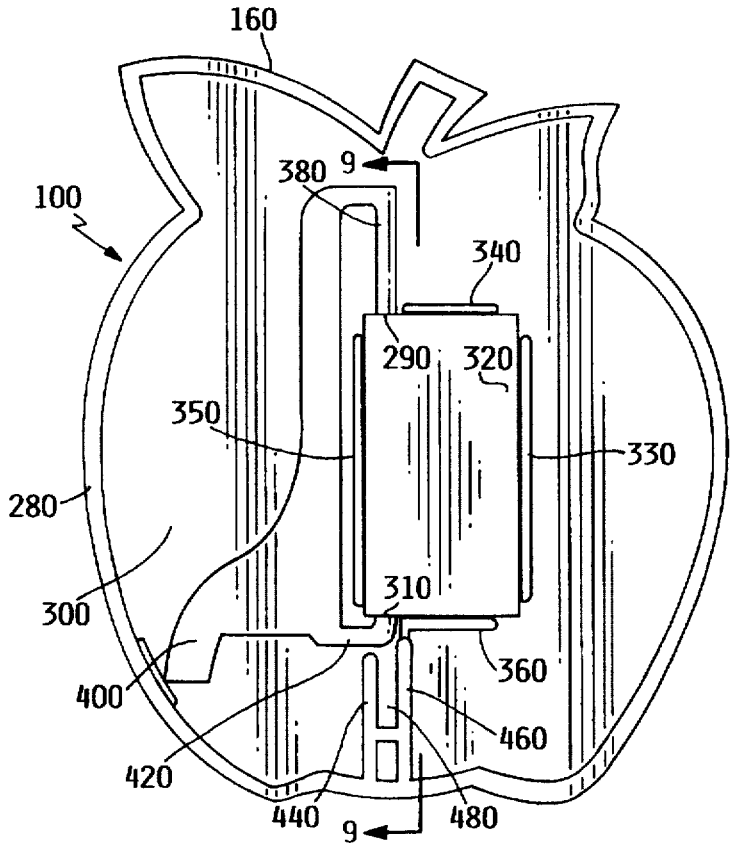
FIG. 8 shows a rear plan view of the device of FIG. 6.

FIG. 8 shows a rear plan view of picture holder 100, showing the outer perimeter 160 being formed by a raised edge 280 which surrounds an inner recess 300. A number of raised ribs are formed on the inner recess 300 to provide various projecting members for purposes to be hereinafter described. A rectangular housing 320 is confined within an area defined by raised ribs 330, 340, 350, and 360. Housing 320 has a pair of slots 290, 310 through its respective end walls to permit the pivotal containment of a cylindrical hinge 380. Hinge 380 is joined to a leg member 400 by spacing projections 410, 420. As constructed, hinge 38 is rotatably pivotal within the slots 290, 310 through housing 320, thereby to permit leg member 400 to be pivotally moved from a flat position to a rearwardly-projecting position. The flat position is shown in FIG. 8, wherein leg 400 is adjacent the inner recess 300.

An upstanding rib 440 limits the axial movement of hinge 38 by abutting against spacing projection 420. However, when leg 400 is pivotally moved to a rearwardly-projecting position, hinge 380 may be axially moved into a channel 480 which is formed between ribs 440 and 460. In this position, further pivotal movement of leg member 400 is restricted; and the picture holder 100 is positioned for supporting on a flat surface by means of leg 400.

Figure 9:
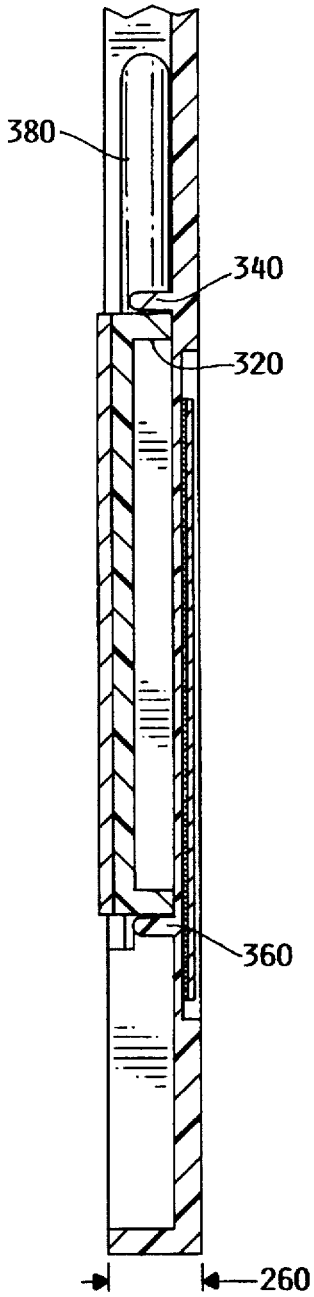
FIG. 9 shows a cross-section view taken along the lines 9—9 of FIG. 7.

FIG. 9 shows a cross-section view taken along the lines 9—9 of FIG. 8. This view illustrates the relative positions of hinge 380, housing 320 and ribs 340 and 360. This view also illustrates that all of the members formed against the rear surface 300 are confined within a dimension limited by the thickness 260 of the picture holder 100.

What is Claimed is:

1. A picture holder and ornamental frame, comprising:

a) a substantially flat top surface comprising an image portion, said surface being adapted for applying an ornamental image thereto;

b) a perimeter about said image portion having an edge shaped to conform to the outline of an ornamental image, said edge having a predetermined height extending rearwardly away from said top surface;

c) a photo recess formed at least partially into said top surface, said photo recess having a recessed surface offset lower than said top surface;

d) a rear surface being defined by the inverse side of said image portion and being recessed within the perimeter defined by said edge;

e) a hinged photo stand attached to said rear surface, said photo stand having a pivotal support foot connected to a hinge pin, and said hinge pin pivotally held against said rear surface; and f) a pair of spaced apart walls arising from said rear surface, the space between said walls being aligned with said hinge pin and being adjacent and not in contact with an end of said hinge pin, whereby said hinge pin can be slidably moved in a linear motion along the axis of the hinge pin between said pair of spaced apart walls.

2. The apparatus of claim 1, wherein the predetermined height of said edge is greater than the pivotal support foot and hinge pin thickness.

3. The apparatus of claim 2, further comprising a magnetic strip affixed against said rear surface.

4. The apparatus of claim 3, further comprising an adhesive strip affixed against the recessed surface of said photo recess.

* * * * *